US007422304B2

(12) United States Patent
Hosono

(10) Patent No.: US 7,422,304 B2
(45) Date of Patent: Sep. 9, 2008

(54) LIQUID EJECTING HEAD AND LIQUID EJECTING APPARATUS INCORPORATING THE SAME

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 244 days.

(21) Appl. No.: 11/178,587

(22) Filed: Jul. 12, 2005

(65) Prior Publication Data

US 2007/0216725 A1 Sep. 20, 2007

(30) Foreign Application Priority Data

Jul. 13, 2004 (JP) ..... P2004-205627

(51) Int. Cl.
*B41J 29/393* (2006.01)

(52) U.S. Cl. ..... 347/19; 347/7; 347/14; 347/68; 347/54

(58) Field of Classification Search ..... 347/6, 347/7, 19, 54, 68, 14, 5
See application file for complete search history.

(56) References Cited

U.S. PATENT DOCUMENTS 6,585,340 B1 * 7/2003 Borrell ..... 347/14
2003/0146945 A1 8/2003 Inui et al.
2003/0234826 A1 * 12/2003 Hosono et al. ..... 347/10
2004/0119765 A1 6/2004 Fujimori et al.
2005/0128230 A1 * 6/2005 Chelvayohan ..... 347/7

FOREIGN PATENT DOCUMENTS

| | | | |
|---|---|---|---|
| EP | 0 983 863 | A1 | 3/2000 |
| JP | 5-88552 | A | 4/1993 |
| JP | 10-278360 | A | 10/1998 |
| WO | WO 98/52762 | A2 | 11/1998 |

* cited by examiner

*Primary Examiner*—Matthew Luu
*Assistant Examiner*—Henok Legesse
(74) *Attorney, Agent, or Firm*—Sughrue Mion, PLLC

(57) ABSTRACT

A liquid ejecting head is provided with pressure chambers adapted to contain liquid. Nozzle orifices are respectively communicated with the pressure chambers and arranged so as to form nozzle arrays. Each of pressure generating elements is operable to generate pressure fluctuation in the liquid contained in one of the pressure chambers to eject at least a first amount of a liquid droplet and a second amount of a liquid droplet from one of the nozzle orifices toward a target medium. A first storage stores first information indicative of a first deviation of the first amount from a first reference amount for each of the nozzle arrays. A second storage stores second information indicative of a correlation between the first deviation and a second deviation of the second amount from a second reference amount. A processor is operable to calculate the second deviation for each of the nozzle arrays with reference to the first information and the second information.

5 Claims, 7 Drawing Sheets

LIQUID EJECTING HEAD AND LIQUID EJECTING APPARATUS INCORPORATING THE SAME

BACKGROUND OF THE INVENTION

The present invention relates to a liquid ejecting apparatus, such as an ink jet printer, and a liquid ejecting head attached to the same, and relates, in particular, to a liquid ejecting apparatus and a liquid ejecting head which allow liquid to be ejected in the form of a liquid droplet in response to an operation of a pressure generating element and thereby form a dot on a target medium.

A liquid ejecting apparatus is an apparatus which comprises a liquid ejecting head capable of ejecting liquid in the form of a liquid droplet, and in which various kinds of liquids can be ejected from the liquid ejecting head. A typical example of the liquid ejecting apparatus is an image recording apparatus such as an ink jet printer (simply referred to as a printer, hereinafter) which comprises an ink jet type recording head (simply referred to as a recording head, hereinafter) serving as a liquid ejecting head, and thereby ejecting liquid ink in the form of an ink droplet from the recording head onto recording paper serving as a target medium, so that the impacted ink forms a dot and thereby achieves image recording. In recent years, such a liquid ejecting apparatus is used not only as an image recording apparatus but also as various kinds of manufacturing apparatuses such as a display manufacturing apparatus.

The recording head of the above-mentioned printer comprises: a plurality of nozzle arrays each composed of nozzle orifices arranged in line and connected to a pressure chamber; and a pressure generating element for generating a fluctuation in the pressure in the pressure chamber. Then, ink stored in an ink cartridge is introduced into the pressure chamber, and then the pressure generating element is driven, so that the ink in the pressure chamber is ejected in the form of an ink droplet from the nozzle orifice.

The liquid droplet amount (weight or volume; referred to as an ejected liquid droplet amount, hereinafter) of an ink droplet ejected from the nozzle orifice increases or decreases depending on the drive voltage value of a driving signal provided to the pressure generating element. Thus, during the manufacturing of the recording head, an averaged liquid droplet amount is acquired for the ink droplets ejected from all the nozzle orifices, so that the drive voltage value of the driving signal is set up such that this averaged liquid droplet amount should equal to a reference value of the design (referred to as a designed liquid droplet amount, hereinafter).

Then, in order that a user should recognize the timing of change of the ink cartridge when the ink in the ink cartridge decreases, the number of times of ejection of the ink droplet is counted. Then, the counted value is multiplied by the liquid droplet amount (weight or volume) of the ink droplet, so that the consumed amount is calculated. Then, on the basis of the consumed amount, the residual amount of the ink in the ink cartridge is notified to the user (see, for example, Japanese Patent Publication No. 5-48552A). This avoids the necessity that a sensor or the like for detecting the residual amount of the ink in the ink cartridge should be provided separately, and thereby allows a simple configuration to acquire the residual amount of the ink.

The driving signal in which the drive voltage value is set up as described above is used in common with the pressure generating element of each nozzle array. Nevertheless, the ejected liquid droplet amount at the time that the ink droplet is ejected in response to the driving signal tends to vary depending on each nozzle array. That is, the ejected liquid droplet amount can be greater than the designed liquid droplet amount in a specific nozzle array, while smaller in another nozzle array. This variation can be attributed to the dimension precision, the assembly precision, and the like of the components.

Such a variation in each nozzle array relative to the designed liquid droplet amount causes various problems. For example, in the above-mentioned printer, in general, each nozzle array corresponds to ink of a different kind (color). Thus, a variation in the ejected liquid droplet amount of each nozzle array affects the hue (color balance) of the image in the recording paper. That is, the color becomes deeper in a nozzle array having an ejected liquid droplet amount greater than the designed liquid droplet amount, while the color becomes lighter in a nozzle array having a smaller ejected liquid droplet amount. For example, when the nozzle array corresponding to magenta has an ejected liquid droplet amount greater than the designed liquid droplet amount, the recorded image becomes reddish in comparison with the image to be originally acquired.

Further, in the case that the ejected liquid droplet amount varies depending on each nozzle array, when the residua amount of the ink in the ink cartridge is to be calculated, an error can arise between the calculated consumed ink amount and the actual consumed ink amount. When such an error arises, an inaccurate residual ink amount is notified to the user. This causes a discrepancy in the timing of change of the ink cartridge recognized by the user from the preferred replacement timing.

SUMMARY OF THE INVENTION

It is therefore an object of the invention to reduce an influence of a variation in the ejected liquid droplet amount for each nozzle array to the ejection control for the liquid droplet and the calculation control for the consumed liquid amount.

In order to achieve the above object, according to the invention, there is provided a liquid ejecting apparatus, comprising:

a liquid ejecting head, comprising:

pressure chambers, adapted to contain liquid;

nozzle orifices, respectively communicated with the pressure chambers and arranged so as to form nozzle arrays; and pressure generating elements, each of which is operable to generate pressure fluctuation in the liquid contained in one of the pressure chambers to eject at least a first amount of a liquid droplet and a second amount of a liquid droplet from one of the nozzle orifices toward a target medium;

a first storage, storing first information indicative of a first deviation of the first amount from a first reference amount for each of the nozzle arrays;

a second storage, storing second information indicative of a correlation between the first deviation and a second deviation of the second amount from a second reference amount; and a processor, operable to calculate the second deviation for each of the nozzle arrays with reference to the first information and the second information.

Preferably, the liquid ejecting apparatus further comprises a third storage, storing third information indicative of a correlation between an ejected amount of the liquid droplet and a color reproduced on a target medium. The processor is operable to calculate a third deviation of the color from a reference color with reference to the third information and either the first information or the second information. The processor is operable to adjust, for each of the nozzle arrays, a consumption amount of the liquid consumed for a prescribed operation with reference to the third deviation.

Here, it is preferable that the liquid ejection apparatus further comprises a reservoir storing the liquid. The processor is operable calculate a residual amount of liquid in the reservoir with reference to the adjusted consumption amount.

According to the invention, there is also provided a liquid ejecting apparatus, comprising:

a liquid ejecting head, comprising:

pressure chambers, adapted to contain liquid;

nozzle orifices, respectively communicated with the pressure chambers and arranged so as to form nozzle arrays; and pressure generating elements, each of which is operable to generate pressure fluctuation in the liquid contained in one of the pressure chambers to eject a specified amount of a liquid droplet from one of the nozzle orifices toward a target medium;

a first storage, storing first information indicative of a first deviation of the selected amount from a reference amount for each of the nozzle arrays;

a second storage, storing second information indicative of a correlation between an ejected amount of the liquid droplet and a color reproduced on a target medium, wherein:

the processor is operable to calculate a second deviation of the color from a reference color with reference to the first information and the second information; and the processor is operable to adjust, for each of the nozzle arrays, a consumption amount of the liquid consumed for a prescribed operation with reference to the second deviation.

Preferably, the liquid ejection apparatus further comprises a reservoir storing the liquid. The processor is operable calculate a residual amount of liquid in the reservoir with reference to the adjusted consumption amount.

According to the invention, since it is possible to reduce as much as possible the influence of the deviation in the ejected amount from the designed amount for each nozzle array, the ejection control for the liquid droplet with higher precision can be attained. That is, for example, when the invention is applied to an image recording apparatus such as an ink jet printer, the density and the hue in the recorded image can be realized as designed.

In addition, since the error between the calculated consumption amount and the actual consumption amount of the liquid can be reduced, the recognition of a more precise residual liquid amount can be attained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
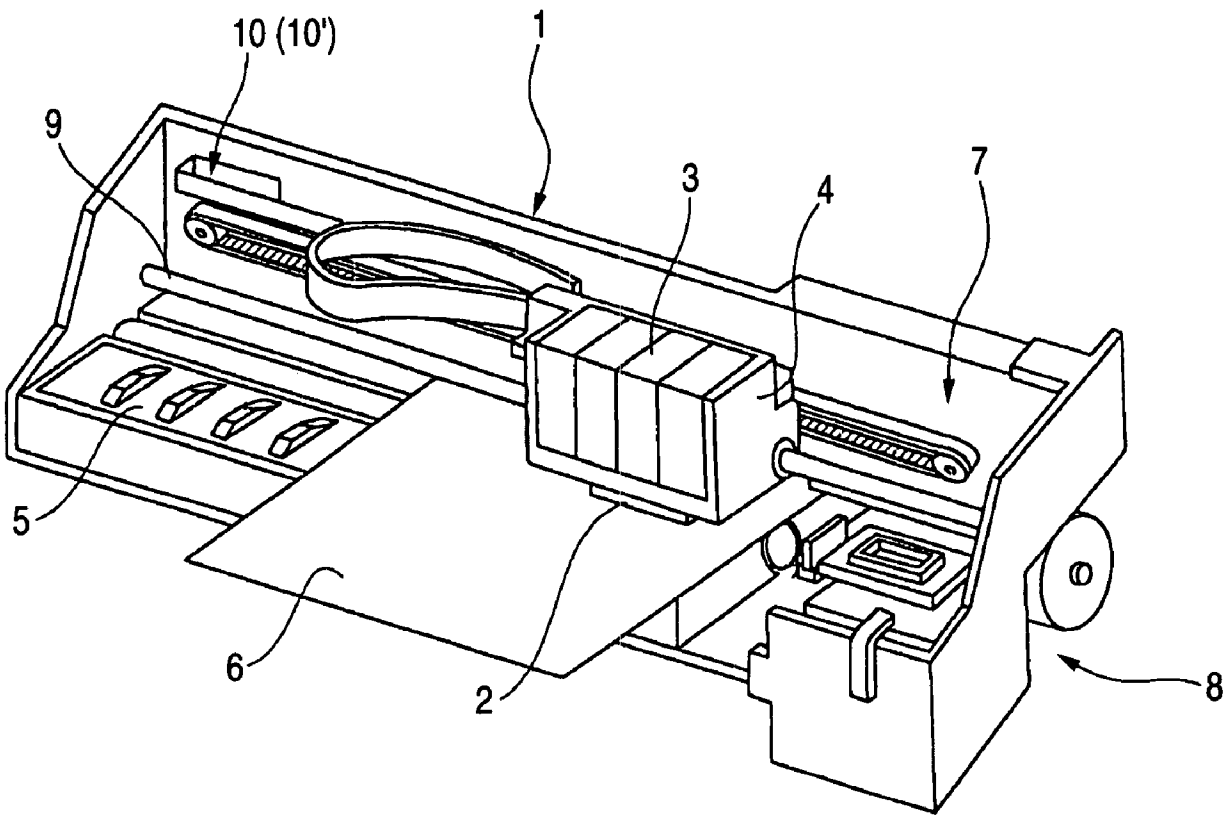
FIG. 1 is a perspective view describing the configuration of a printer according to one embodiment of a liquid ejecting apparatus of the invention.

Embodiments of the invention will be described below in detail with to the accompanying drawings. In the following description, an ink jet printer (simply referred to as a printer, hereinafter) shown in FIG. 1 serves as an example of the liquid ejecting apparatus of the invention.

The printer 1 comprises in general: a carriage 4 to which a recording head 2 (liquid ejecting head) and an ink cartridge 3 detachably attached to the recording head 2; a platen 5 arranged under the recording head 2; a carriage moving mechanism 7 for moving the carriage 4 (recording head 2) in primary scanning directions which are the directions of paper width of recording paper 6 (target medium); and a sheet feeding mechanism 8 for feeding the recording paper 6 in a secondary scanning direction (direction of paper feeding) perpendicular to the head moving directions.

The carriage 4 is attached in a manner pivotally supported by a guide rod 9 bridging in the primary scanning directions, and thereby travels in the primary scanning directions along the guide rod 9 in response to the operation of the carriage moving mechanism 7. The position of the carriage 4 in the primary scanning directions is detected by a linear encoder 10 comprising, for example, a scale 10' extending in the primary scanning directions of the housing of the printer 1 and a photo interrupter attached to the carriage 4. A detection signal from the linear encoder 10 is transmitted as position information to a processor 41 (see FIG. 3) of a printer controller 35. Thus, with recognizing the scanning position of the carriage 4 (recording head 2) on the basis of the position information from the linear encoder 10, the processor 41 can control the recording operation (ejecting operation) and the like of the recording head 2.

Figure 2:
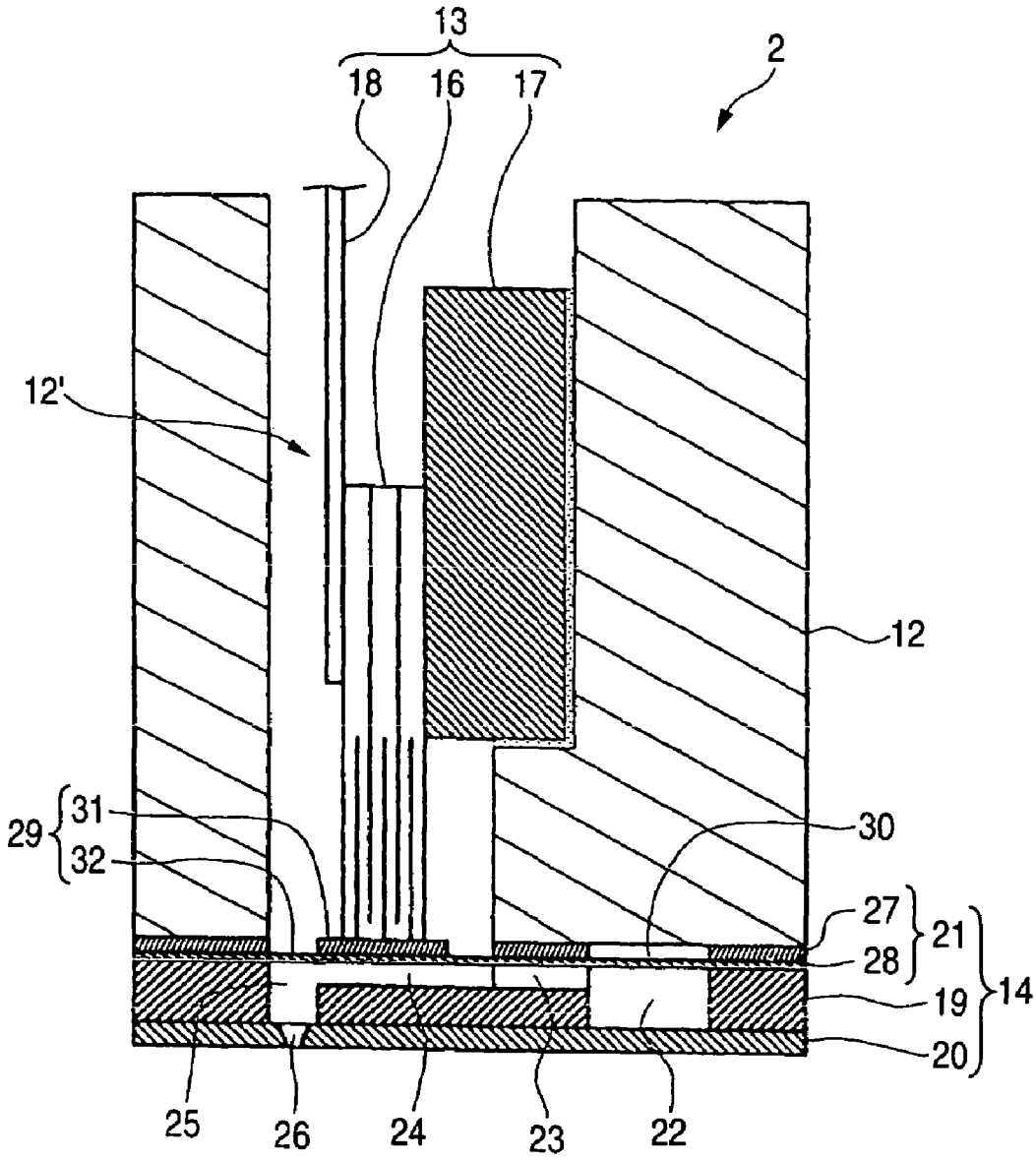
FIG. 2 is a sectional view of a main part of a recording head in the printer of FIG. 1.

As shown in FIG. 2, the recording head 2 includes: a casing 12 fabricated from an epoxy resin or the like; a vibrator unit 13 accommodated in a space 12' formed inside the casing 12; and a channel unit 14 joined to the bottom surface (tip surface) of the casing 12. The vibrator unit 13 comprises: a piezoelectric vibrator 16 (pressure generating element); a stationary plate 17 to which the piezoelectric vibrator 16 is joined; and a flexible cable 18 for providing a driving signal and the like to the piezoelectric vibrator 16. The piezoelectric vibrator 16 in the present embodiment is of a laminated type fabricated by cutting, in the pectinated shape, a piezoelectric plate composed of an alternating lamination of piezoelectric material layers and electrode layers. Thus, the piezoelectric vibrator 16 is a piezoelectric vibrator of the longitudinal vibration mode in which expansion and contraction can occur along a direction (a line) perpendicular to the laminated direction. Employable pressure generating elements other than the piezoelectric vibrator 16 include: a piezoelectric vibrator of the so-called flexural mode in which vibration can occur in the electric field direction (laminated direction of the piezoelectric materials and the internal electrodes); and a heat generating element.

The channel unit 14 is constructed by joining a nozzle plate 20 to one surface of a channel formation substrate 19 while an elastic plate 21 to the other surface of the channel formation substrate 19. The channel unit 14 is provided with a reservoir 22, an ink supply port 23, a pressure chamber 24, a nozzle communicating port 25, and a nozzle orifice 26. Then, a route of ink channel going from the ink supply port 23 through the pressure chamber 24 and the nozzle communicating port 25 to the nozzle orifice 26 is formed in correspondence to each nozzle orifice 26.

The above-mentioned nozzle plate 20 is a metal thin plate in which a plurality of nozzle orifices 26 are arranged in line at a pitch corresponding to a dot formation density (for example, 180 dpi). In the present embodiment, the nozzle plate 20 is constructed from a plate made of stainless steel, while a plurality of arrays (nozzle arrays) of the nozzle orifices 26 are arranged. One nozzle array consists, for example, of 180 nozzle orifices 26. Four ink cartridges 3 each of which stores ink of a color different from each other can be attached to the recording head 2 of the present embodiment. Specifically, these four colors are cyan (C), magenta (M), yellow (Y), and black (K). Thus, four nozzle arrays in total are formed in the nozzle plate 20 in correspondence to the four colors. In the present embodiment, the above-mentioned vibrator unit 13 is provided for each of these nozzle arrays. That is, the recording head 2 comprises four vibrator units 26 in total in correspondence to the nozzle arrays.

The above-mentioned elastic plate 21 has a dual structure in which an elastic material film 28 is laminated on the surface of a supporting plate 27. In the present embodiment, the supporting plate 27 is composed of a stainless plate which is a kind of metal plate. Then, the elastic plate 21 is fabricated from a composite plate in which a resin film serving as the elastic material film 28 is laminated on the surface of the supporting plate 27. The elastic plate 21 is provided with: a diaphragm section 29 for changing the volume of the pressure chamber 24; and a compliance section 30 for sealing a part of the reservoir 22.

The above-mentioned diaphragm section 29 is fabricated by partially removing the supporting plate 27 by an etching process or the like. That is, the diaphragm section 29 comprises: an island section 31 to which the tip end face of the piezoelectric vibrator 16 is joined; and a thin elastic section 32 surrounding the island section 31. The above-mentioned compliance section 30 is fabricated by removing an area of the supporting plate 27 opposing the opening face of the reservoir 22 by an etching process or the like similarly to the case of the diaphragm section 29, and then serves as a damper for absorbing a pressure fluctuation in the liquid stored in the reservoir 22.

The tip end face of the piezoelectric vibrator 16 is joined to the above-mentioned island section 31. Thus, when the free end section of the piezoelectric vibrator 16 is expanded and contracted, the volume of the pressure chamber 24 can be fluctuated. This volume fluctuation causes a pressure fluctuation in the ink in the pressure chamber 24. Then, using this pressure fluctuation, the recording head 2 ejects the ink in the form of an ink droplet (liquid droplet) from the nozzle orifice 26.

Figure 3:
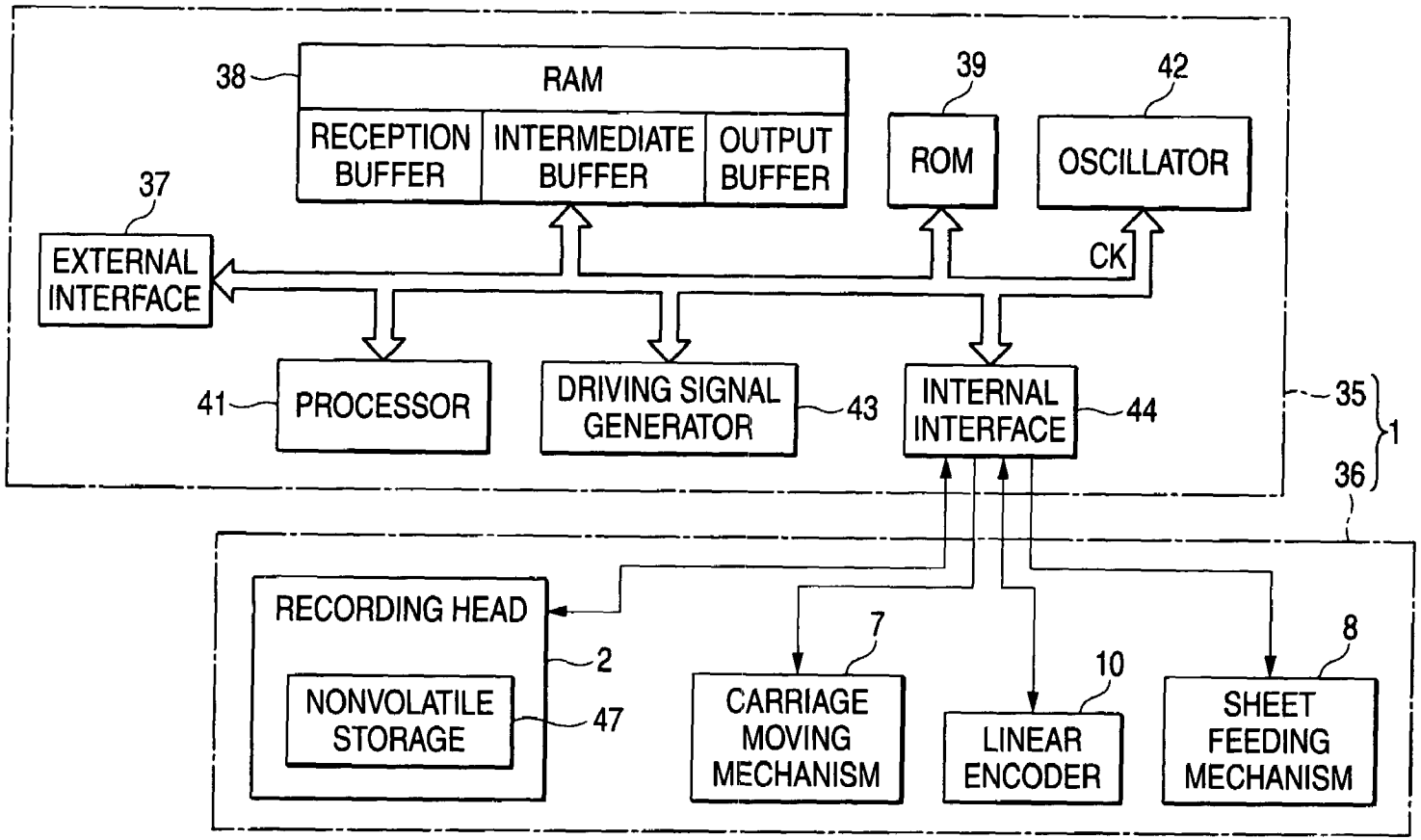
FIG. 3 is a block diagram showing the electrical configuration of the printer of FIG. 1.

In general, as shown in FIG. 3, the printer 1 comprises a printer controller 35 and a print engine 36. The printer controller 35 comprises: an external interface (external I/F) 37 through which print data and the like are inputted from an external device such as a host computer; a RAM 38 for storing various data and the like; a ROM 39 for storing a control routine and the like for various data processing; a processor 41 for controlling each section; an oscillator 42 for generating a clock signal; a driving signal generator 43 for generating a driving signal provided to the recording head 2; and an internal interface (internal I/F) 44 for outputting ejection data, the driving signal, and the like acquired by expanding the print data into each dot, to the recording head 2.

In general, the print engine 36 comprises the recording head 2, the carriage moving mechanism 7, the linear encoder 10, and the sheet feeding mechanism 8. The recording head 2 is provided with a nonvolatile storage 47. The nonvolatile storage 47 stores, for example, information concerning the dispersion and the like in the ejected liquid droplet amount of each nozzle array. The processor 41 can read appropriately the information stored in the nonvolatile storage 47, and then perform the control according to the read-out information. The various kinds of control performed using the information stored in the nonvolatile storage 47 is described later.

The above-mentioned printer 1 can operate in a plurality of kinds of recording modes (ejecting mode) such as high speed printing and high resolution printing depending on the usage. In the present embodiment, selection can be made from three kinds of modes: a normal mode for performing normal recording operation; a high speed mode for performing higher speed recording; and a high resolution mode for performing higher resolution recording. The driving signal generator 43 generates driving signals having different waveforms corresponding to the respective modes.

Figure 4:
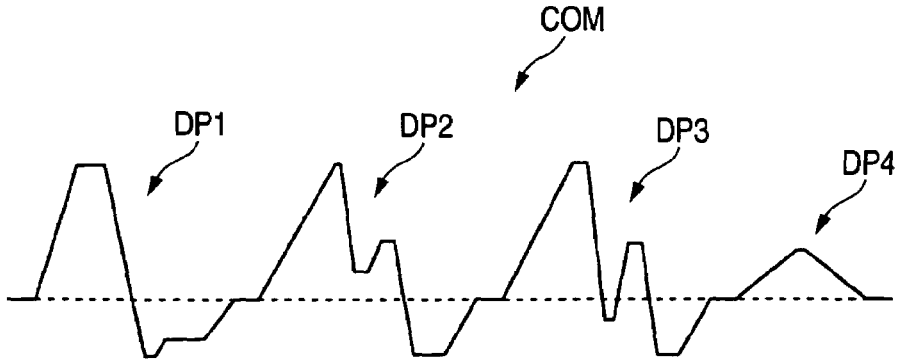
FIG. 4 is a diagram showing a driving signal used in the printer of FIG. 1.

FIG. 4 is a diagram describing the configuration of a driving signal COM (VSD3) used in the high resolution mode for performing the recording by using the minimum dot set (a group of dots of different sizes) among the above-mentioned recording modes. The driving signal COM contains a plurality of kinds of driving pulses each for ejecting an ink droplet having a liquid droplet amount different from each other. Specifically, as shown in FIG. 4, the driving signal COM is constructed from: a large-dot driving pulse DP1 for ejecting an ink droplet having a liquid droplet amount (for example, 7 ng) capable of forming a large dot; a small-dot driving pulse DP2 for ejecting an ink droplet having a liquid droplet amount (for example, 1.5 ng) capable of forming a small dot; and a medium-dot driving pulse DP3 for ejecting an ink droplet having a liquid droplet amount (for example, 3 ng) capable of forming a medium dot. In addition to these driving pulses of the dot set, the driving signal COM further contains a vibrating pulse DP4 for causing fine vibration in the meniscus exposed in the nozzle orifice 40 but not causing the ejection of an ink droplet. That is, the printer 1 of the present embodiment can perform the recording operation in the four gradation levels consisting of the large dot, the medium dot, the small dot, and the non-recording (fine vibration).

Here, a liquid droplet amount on the design necessary for forming a dot of each size in each recording mode is referred to as a designed liquid droplet amount. For example, in the above mentioned high resolution mode, the designed liquid droplet amount corresponding to the large dot is 7 ng. The designed liquid droplet amount corresponding to the medium dot is 3 ng. The designed liquid droplet amount corresponding to the small dot is 1.5 ng.

The above-mentioned processor 41 controls: the ejection of the ink droplet from the recording head 2 (recording control); and the other sections of the printers 1, according to the operation program and the like stored in the ROM 39. The processor 41 converts print data (RGB data) inputted from an external device via the external interface 37, into ejection data (dot pattern data) used for the ink droplet discharge in the recording head 2. In the present embodiment, the above-mentioned ROM 39 stores a look-up table (dot formation rate table) specifying the dot formation rate on the target medium for each dot. This dot formation rate specifies the rate at which each dot (large, medium, and small) of each ink color (C, M, Y, and K) should be formed on the recording paper 6 depending on the gradation level of the image of the print data. The processor 41 converts the data on the basis of the look-up table. The converted ejection data is transmitted to the recording head 2 through the internal I/F 44. Then, in the recording head 2, on the basis of this ejection data, the provision of the driving signal COM (driving pulses) to the piezoelectric vibrator 16 is controlled so that the ejection of the ink droplet, that is, the recording operation, is performed.

Further, the processor 41 also calculates the consumed amount of the ink in each ink cartridge 3 depending on the ejection of the ink droplet from the recording head 2 (ink counter control). Specifically, for each ink cartridge 3 (each ink color), the processor 41 counts the number of times of ejection of the ink droplet for each recording mode and each dot size, then multiplies the ejection count value by the liquid droplet amount (weight or volume) of the ink droplet, that is, by the designed liquid droplet amount corresponding to each dot size in each recording mode, and thereby calculates the dot consumption amount for each dot size in each recording mode. For example, in the ink cartridge 3 for storing cyan ink, when the ejection count value of the ink droplet for the medium dot in the high resolution mode is 1000, this ejection count value is multiplied by 3 ng which is the designed liquid droplet amount corresponding to the medium dot in the high resolution mode. Then, 3000 ng is obtained as the medium dot consumption amount.

Then, the processor 41 sets the total value of the dot consumption amounts in each recording mode to be the consumed amount of the ink in the corresponding ink cartridge 3. The residual ink amount (residual liquid amount) in the ink cartridge 3 obtained on the basis of the consumed amount of the ink is notified to the user through the display or the like. This allows the user to recognize easily the replacement timing for the ink cartridge 3.

Meanwhile, in the above-mentioned recording head 2, variations in the dimension precision, the assembly precision, and the like of the components can cause the situation that the liquid droplet amount (ejected liquid droplet amount) of the actually ejected ink droplet does not agree with the designed liquid droplet amount. In particular, in a configuration having a separate vibrator unit 13 for each nozzle array similarly to the present embodiment, individual specificity of each vibrator unit 13 affects the situation. Thus, when the driving signal COM is shared by each vibrator unit 13, the ejected liquid droplet amount of each nozzle array tends to vary relative to the designed liquid droplet amount. Then, the variation in the ejected liquid droplet amount affects the hue of the recorded image. That is, when recording is performed under the same condition for each nozzle array, the color becomes deeper in a nozzle array having an ejected liquid droplet amount greater than the designed liquid droplet amount, while the color becomes lighter in a nozzle array having an ejected liquid droplet amount smaller than the designed liquid droplet amount.

Further, the discrepancy of the ejected liquid droplet amount from the designed liquid droplet amount causes an error between the calculated consumed ink amount and the actual consumed ink amount in each ink cartridge 3. When such an error arises, an inaccurate residual ink amount is notified to the user. As a result, the timing of change of the ink cartridge recognized by the user differs from the originally desired one.

In order that these problems should be avoided, in the above-mentioned printer 1, the nonvolatile storage 47 of the recording head 2 stores: information concerning the dispersion in the ejected liquid droplet amount of each nozzle array; and information used for performing the above-mentioned recording control (ejection control) and the ink counter control (calculation control for the residual liquid amount) with higher precision in accordance with the above-mentioned dispersion (deviation from the designed amount). Then, on the basis of the information stored in the nonvolatile storage 47, the processor 41 performs the recording control and the ink counter control, and thereby suppresses as much as possible the influence of the above-mentioned variation.

One information item concerning the variation in the ejected liquid droplet amount of each nozzle array is deviation information indicating the degree of deviation of the ejected liquid droplet amount of each nozzle array relative to the designed liquid droplet amount. Specifically, this deviation information is acquired as follows.

First, in the inspection process for the recording head 2 having been assembled, the average value of the ejected liquid droplet amounts of the nozzle orifices 26 constituting the nozzle array is measured for each nozzle array (each ink color). Then, the average value is set to be the ejected liquid droplet amount of the nozzle array concerned. After that, the deviation of the ejected liquid droplet amount of each nozzle array relative to the designed liquid droplet amount is acquired. Then, this deviation is stored as the deviation information into the nonvolatile storage 47 of the recording head 2.

In the present embodiment, for example, all the nozzle orifices 26 belonging to the nozzle array subjected to the measurement are caused to discharge an ink droplet in a predetermined number of times. The ejected ink droplets are caught by an electronic balance 57, so that their weight is measured. Then, the measurement result is divided by the number of times of ejection and the number of nozzle orifices 26, so that the measurement value of the ejected liquid droplet amount of the nozzle array concerned is obtained. Then, the deviation of the measurement value of the ejected liquid droplet amount relative to the designed liquid droplet amount is calculated. For example, in a specific nozzle array, when the ejected liquid droplet amount (measurement value) corresponding to the small dot in the high resolution mode is 1.35 ng, the deviation Dv of the ejected liquid droplet amount relative to the designed liquid droplet amount 1.5 ng is calculated as follows, when the designed liquid droplet amount is defined as 100%.

$$Dv=100-(1.35/1.50)\times 100=10(\%)$$

As such, the deviation Dv of the ejected liquid droplet amount specific to each nozzle array (each ink color) relative to the designed liquid droplet amount is calculated. This deviation Dv is stored as the deviation information for each nozzle array into the nonvolatile storage 47. In the above-mentioned example, the ejected liquid droplet amount is smaller than the designed liquid droplet amount by 10%. Thus, "−10%" is stored as the deviation information (deviation Dv) corresponding to the small dot in the high resolution mode of the nozzle array concerned, into the nonvolatile storage 47.

Meanwhile, the approach that the ejected liquid droplet amount is measured by causing the ink droplet to actually be ejected for all dot sizes (designed liquid droplet amounts) of all recording modes and that the deviation information is then obtained is poor in working efficiency. Further, a large storage area is consumed inefficiently in the nonvolatile storage 47.

Thus, in the present embodiment, attention is focused on the fact that correlation relationship is present in the deviation information (deviations Dv) between the designed liquid droplet amounts different from each other. Then, the deviation information (first deviation information) of the measurement value of the ejected liquid droplet amount corresponding to a specific designed liquid droplet amount (first designed liquid droplet amount) is acquired. Then, the first deviation information and the information (correlation information) indicating the above-mentioned correlation relationship are stored into the nonvolatile storage 47 in a manner made to correspond to each nozzle array (ink color). That is, the nonvolatile storage 47 serves also as the deviation correction information storing means of the invention.

Then, on the basis of the first deviation information and the correlation information stored in the nonvolatile storage 47, the processor 41 calculates the deviation information (second deviation information) of another designed liquid droplet amount (second designed liquid droplet amount) for each nozzle array when necessary.

In the following description, the designed liquid droplet amount (1.5 ng) corresponding to the small dot in the above-mentioned high resolution mode is used as the first designed liquid droplet amount, while the designed liquid droplet amount (3 ng) corresponding to the medium dot in that mode is used as the second designed liquid droplet amount.

Figure 5:
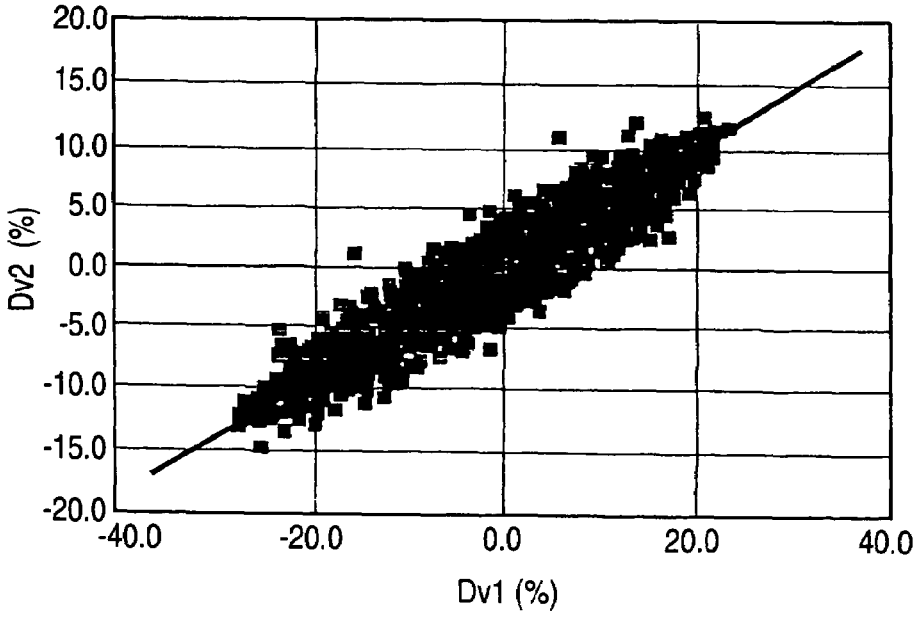
FIG. 5 is a graph showing the correlation between first deviation information of a first designed liquid droplet amount and second deviation information of a second designed liquid droplet amount, which is utilized in the printer of FIG. 1.

FIG. 5 is a graph showing the relationship between the first deviation information (first deviation Dv1 (%): horizontal axis) and the second deviation information (second deviation Dv2 (%): vertical axis). As seen from the figure, a relatively strong correlation relationship is present between the first deviation Dv1 and the second deviation Dv2. The relational formula in this example is expressed as follows (linear approximation).

$$y=0.5x \tag{1}$$

Thus, when the value of the first deviation Dv1 is substituted into x of Formula (1) described here, the second deviation Dv2 (y) is obtained. That is, when the value of the first deviation Dv1 is −10%, this value is multiplied by the coefficient 0.5, so that a value of −5% is obtained. This gives the second deviation Dv2.

In the present embodiment, the coefficient 0.5 in Formula (1) described above is stored as correlation information indicating the correlation relationship of the deviation information between the first designed liquid droplet amount and the second designed liquid droplet amount, into the nonvolatile storage 47. That is, the correlation information also serves as one information item concerning the variation in the ejected liquid droplet amount of each nozzle array.

The above-mentioned description has been given for the case that the designed liquid droplet amount (1.5 ng) corresponding to the small dot in the above-mentioned high resolution mode is used as the first designed liquid droplet amount, while the designed liquid droplet amount (3 ng) corresponding to the medium dot in that mode is used as the second designed liquid droplet amount. However, other designed liquid droplet amounts may be combined and used.

Further, the present embodiment has been described for the case that the coefficient 0.5 in Formula (1) described above is stored as the correlation information into the nonvolatile storage 47. However, in the case that the intercept of the relational formula cannot be ignored, the formula itself including the intercept may be used as the correlation information.

As such, the first deviation information of the measurement value of the ejected liquid droplet amount corresponding to the first designed liquid droplet amount is acquired. Then, the first deviation information and the correlation information are stored into the nonvolatile storage 47. After that, on the basis of the first deviation information and the correlation information stored in the nonvolatile storage 47, the processor 41 calculates the second deviation information if necessary. This avoids the necessity of actually measuring an ejected liquid droplet amount for every designed liquid droplet amount. This simplifies the system. Further, it is sufficient that the first deviation information and the correlation information are stored into the nonvolatile storage 47. This reduces and minimizes the usage area of the nonvolatile storage 47.

Next, described below is the information for performing the recording control and the ink counter control with higher precision in accordance with the variation in the ejected liquid droplet amount of each nozzle array.

Here, when the ink droplet is ejected so that an image is recorded, it is known that a relatively strong correlation relationship is present between the ejected liquid droplet amount at that time and the information (referred to as color information, hereinafter) concerning the color of the recorded image. While various representation systems (calorimetric systems) for representing the color have been proposed, a typical system is the L*a*b* colorimetric system specified in JIS Z8729 (simply referred to as the LAB colorimetric system, hereinafter). In the LAB calorimetric system, the color is represented by three indices consisting of: the L* value indicating the brightness; the a* value (RG chroma) indicating the degree of red or green; and the b* value (YB chroma) indicating the degree of yellow or blue.

Figure 6:
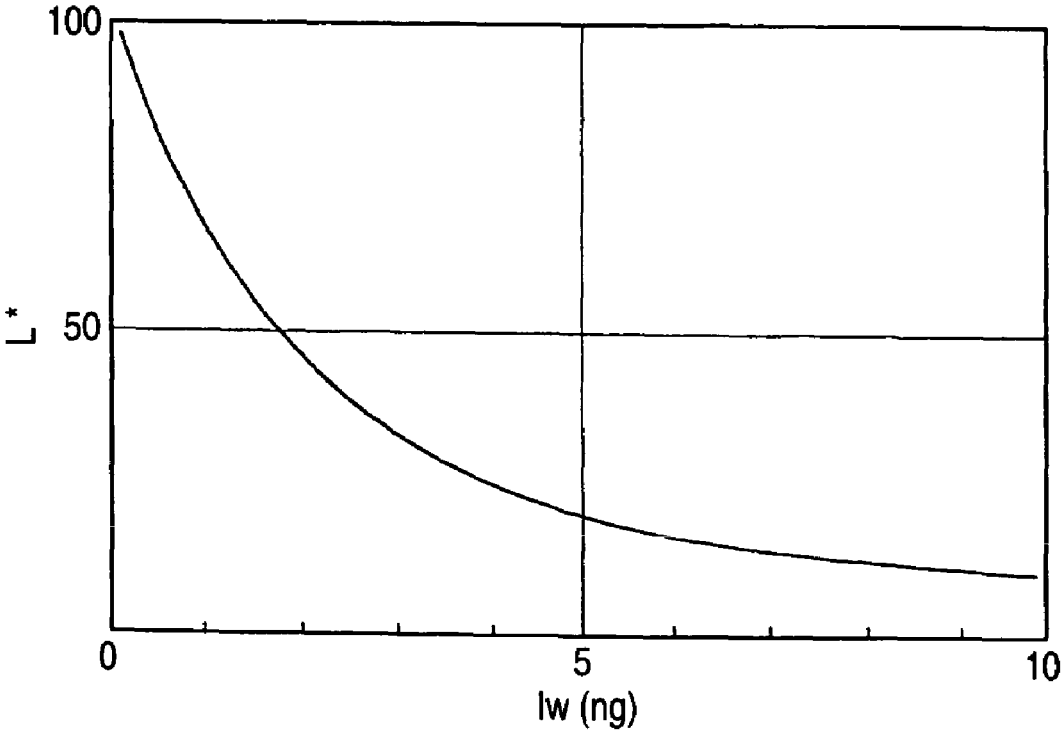
FIG. 6 is a graph showing the correlation between color information (L*value) and an ejected liquid droplet amount, which is utilized in the printer of FIG. 1.

FIG. 6 is a graph showing the relationship between the ejected liquid droplet amount Iw (horizontal axis) of a nozzle array corresponding to cyan ink and the L* value (vertical axis) of an image recorded by ejecting the ink droplet of the ejected liquid droplet amount Iw by a given amount (ejected amount based on the dot formation rate per unit area), as an example of the correlation between the ejected liquid droplet amount of the ink droplet and the color information. In the L* value of FIG. 6, the value 0 indicates the darkest, while the value 100 indicates the brightest. As seen from the figure, with a decreasing ejected liquid droplet amount (approaching 0), the L* value increases, that is, the brightness becomes higher. In contrast, with an increasing ejected liquid droplet amount, the L* value decreases, that is, the brightness becomes lower. That is, when the ink droplet corresponding to a specific designed liquid droplet amount is ejected, and when the actual ejected liquid droplet amount is increased or reduced relative to the designed liquid droplet amount, the color information of the recorded image varies accordingly.

In the above-mentioned printer 1, the information concerning the correlation relationship between the elected liquid droplet amount and the color information is stored into the nonvolatile storage 47 of the recording head 2. This point is described below.

Figure 7:
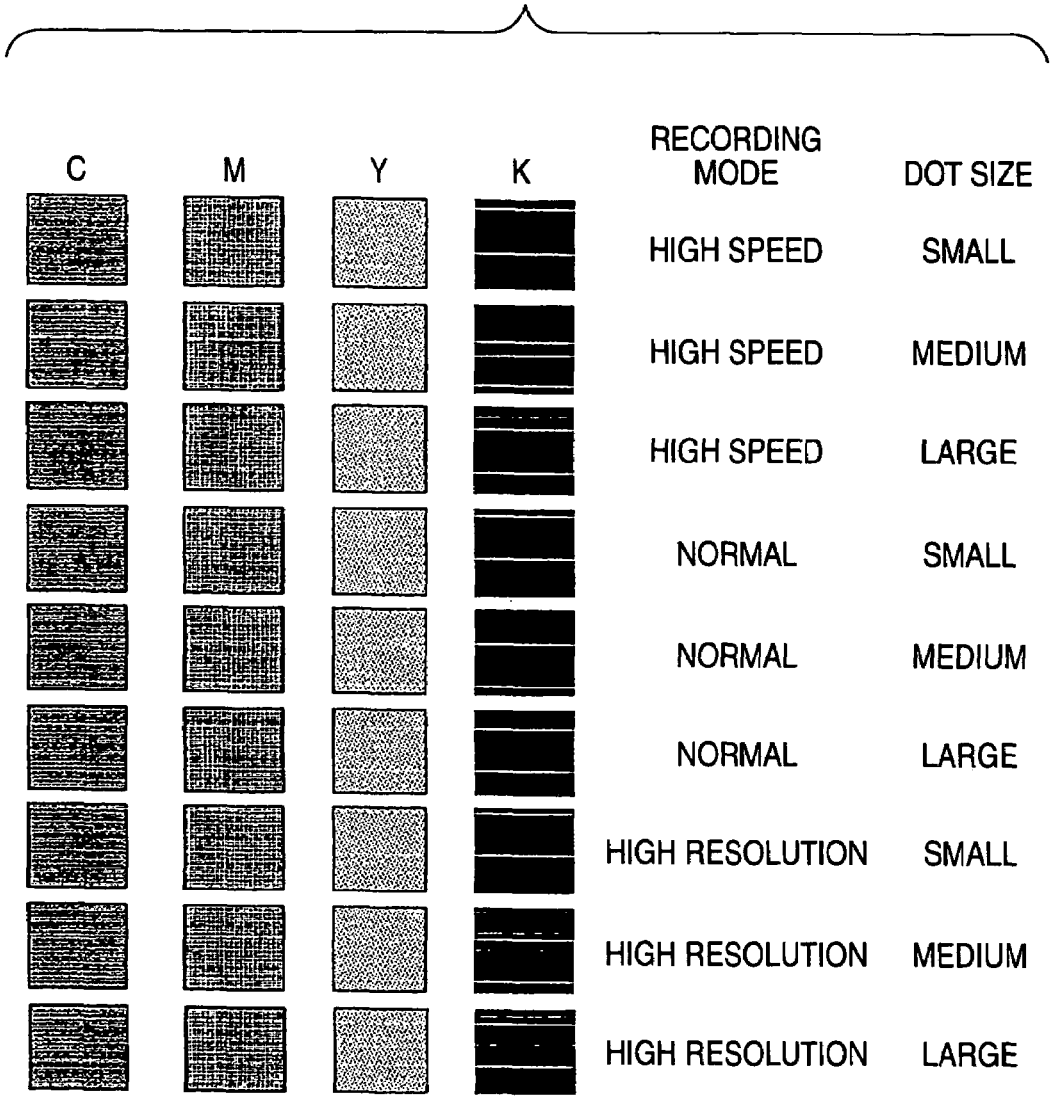
FIG. 7 is a diagram showing an example of a test pattern used with the printer of FIG. 1.

In the present embodiment in the state that the recording head 2 is attached to the printer 1, that is, in the state of an assembled product, the ink droplet is ejected onto the recording paper 6 for each nozzle array (color of the ink), each recording mode, and each designed liquid droplet amount (dot size), so that a dot is formed. As a result, a test pattern is recorded as shown in FIG. 7. Then, the test pattern is measured using a scanner or a colorimeter so that color information is acquired in the above-mentioned LAB color system. At that time, a plurality of test patterns are generated while increasing and decreasing the ejected liquid droplet amount within a predetermined range (a range which generates a variation) relative to the designed liquid droplet amount for each designed liquid droplet amount. Then, the color information is acquired and accumulated for these test patterns. Then, on the basis of the accumulated color information, a relational formula of the change in the color information as a function of the variation (change) in the ejected liquid droplet amount is obtained for each designed liquid droplet amount. This relational formula is obtained, for each nozzle array (each ink color), as the color correlation information for each designed liquid droplet amount of each recording mode, and then stored into the nonvolatile storage 47. Then, the information used for performing the recording control and the ink counter control with higher precision in accordance with the variation in the ejected liquid droplet amount of each nozzle array in the present embodiment indicates the above-mentioned color correlation information.

Figure 8:
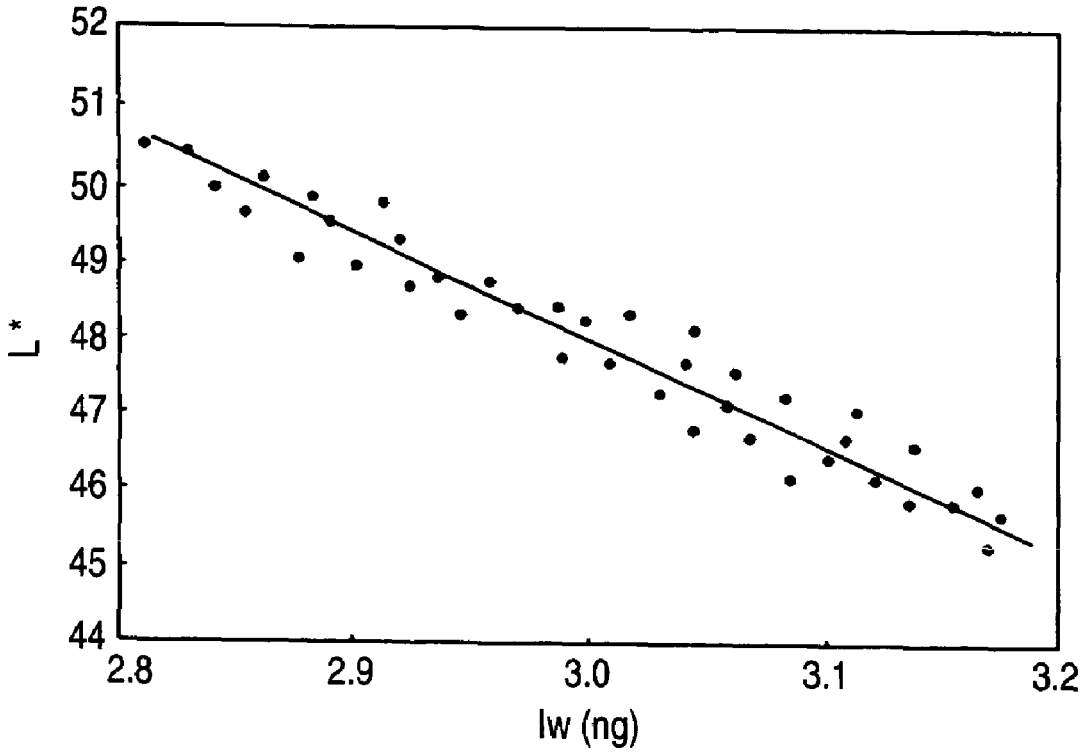
FIG. 8 is a graph showing a change in color information in response to a change in an ejected liquid droplet amount of cyan ink, which is used in the printer of FIG. 1.

FIG. 8 is a diagram showing, as a specific example, the L* value as a function of the ejected liquid droplet amount (variation range of 2.8-3.2 ng) in the case that the ink droplet corresponding to the medium dot (designed liquid droplet amount of 3.0 ng) in the above-mentioned high resolution mode is ejected in a nozzle array corresponding to cyan ink. That is, this corresponds to a graph of FIG. 6 that shows the range of 2.8-3.2 ng (ejected liquid droplet amount Iw). When the range concerned is linearly approximated, the relational formula between the ejected liquid droplet amount Iw and the color information L* value is expressed as the following Formula (2).

$$y=-14x+90 \quad (2)$$

That is, Formula (2) serves as an example of the color correlation information indicating the correlation relationship between the ejected liquid droplet amount and the color information corresponding to the designed liquid droplet amount of the medium dot in the above-mentioned high resolution mode in the nozzle array corresponding to cyan ink.

Here, the strength of the correlation relationship between the ejected liquid droplet amount and the color information depends on the combination between the ink color and the color information. Thus, in order that the correlation relationship should become more apparent, for example, the L* value is preferably adopted as the color information for the case of cyan ink and black ink. Further, the a* value is preferably adopted for magenta ink, while the b* value is preferably adopted for yellow ink.

As described above, the information (deviation information and the correlation information) concerning the variation in the ejected liquid droplet amount of each nozzle array and the information (color correlation information) concerning the correlation relationship between the ejected liquid droplet amount and the color information are stored into the nonvolatile storage 47 of the recording head 2.

Then, the printer 1 performs the recording control on the basis of the information described here. That is, the processor 41 serves as the control means of the invention, and calculates the ejected liquid droplet amount of each nozzle array on the basis of the designed liquid droplet amount and of the deviation information stored in the nonvolatile storage 47. Then, on the basis of the calculated ejected liquid droplet amount and of the color correlation information stored in the nonvolatile storage 47, the processor 41 calculates the color information corresponding to the ejected liquid droplet amount of each nozzle array. Further, the processor 41 calculates the color deviation information of the calculated color information relative to the reference color information (color information of the designed liquid droplet amount). After that, on the basis of the color deviation information, the processor 41 adjusts the dot formation rate on the recording paper 6 for each nozzle array (ink color).

In the present embodiment, three recording modes and three dot sizes are set up. Thus, the above-mentioned adjustment is performed for each dot size of each recording mode.

The following description is given for an exemplary case of the medium dot (designed liquid droplet amount of 3 ng) in the high resolution mode in the nozzle array corresponding to cyan ink. In the present embodiment, the deviation information corresponding to the designed liquid droplet amount concerned is not stored in the nonvolatile storage 47. Thus, the processor 41 first reads from the nonvolatile storage 47 the first deviation information Dv1 from the first designed liquid droplet amount (1.5 ng) corresponding to the small dot in the high resolution mode of the nozzle array concerned, as well as the correlation information between these designed liquid droplet amounts. Then, on the basis of the information described here, the processor 41 calculates the second deviation information Dv2 from the second designed liquid droplet amount (3 ng).

That is, for example, when the value of the first deviation Dv1 serving as the first deviation information is "−10%", and when the correlation information is a coefficient of "0.5", on the basis of the information described here, the processor 41 calculates "−10×0.5=−5%", and thereby obtains the second deviation information Dv2. Then, on the basis of the second deviation information Dv2, the processor 41 calculates the ejected liquid droplet amount of the medium dot in the high resolution mode in the nozzle array corresponding to cyan ink in the present embodiment. In this case, the ejected liquid droplet amount of the medium dot concerned becomes 2.85 ng which is smaller than the designed liquid droplet amount 3 ng by 5%.

Next, the processor 41 calculates the color information on the basis of the calculated ejected liquid droplet amount and the color correlation information corresponding to the designed liquid droplet amount concerned, that is, Formula (2) described above. That is, the L* value (y) serving as the color information in this example is obtained as follows.

$$y=-14\times2.85+90=50.1$$

Further, the processor 41 calculates the color deviation information of the calculated color information (L* value) relative to the reference color information (color information of the designed liquid droplet amount). Here, the reference color information in this example is obtained by substituting the designed liquid droplet amount of 3 (ng) into Formula (2) described above. That is, "y=−14×3+90=48" is obtained. Thus, the color deviation information Dc in this example is calculated as follows, when the reference color information is defined as 100%.

$$Dc=100-(50.1/48)\times100\cong-4\%$$

That is, the color information (L* value) corresponding to the ejected liquid droplet amount of the medium dot (designed liquid droplet amount of 3 ng) in the high resolution mode in the nozzle array concerned is higher than the reference color information by 4%.

As described above, when the color deviation information Dc is calculated, on the basis of the calculated color deviation information Dc, the processor 41 adjusts the dot formation rate on the recording paper 6 for each nozzle array.

In the above-mentioned example, the color deviation information Dc is "−4%". That is, the L* value (brightness) is higher than the reference value by 4%. In other words, the ejected liquid droplet amount is lower than the designed liquid droplet amount by 4%. Thus, the processor 41 controls such as to increase by 4% the dot formation rate of the medium dot concerned. Specifically, for example, when the setting is such that the ink droplet of the medium dot concerned is ejected 100 times so that the ink droplets of 300 ng in total are caused to impact per unit area, the processor 41 adjusts the number of times of ejection of the ink droplet per unit area, into 104 times which is greater by 4%.

That is, adjustment is performed such that in a nozzle array having an ejected liquid droplet amount greater than the designed liquid droplet amount, the dot formation rate should be reduced, while in a nozzle array having an ejected liquid droplet amount smaller than the designed liquid droplet amount, the dot formation rate should be increased. This realizes the density and the hue in the recorded image as designed.

Further, the processor 41 corrects the liquid droplet amount at the time of calculation of the amount of ink consumption in the ink cartridge, on the basis of the color deviation information Dc calculated as described above.

In the above-mentioned example, in the ink cartridge 3 for storing cyan ink, when the ejection count value of the medium dot concerned is 1000, the processor 41 multiplies this ejection count value by 2.88 ng which is smaller by 4% than the designed liquid droplet amount (3 ng) corresponding to the medium dot concerned. Then, 2880 ng is obtained as the consumed ink amount. This reduces the error between the calculated consumed ink amount and the actual consumed ink amount. This provides a residual ink amount higher precision with higher precision.

As described above, on the basis of the above-mentioned information stored in the nonvolatile storage 47 of the recording head 2, the processor 41 calculates the ejected liquid droplet amount of each nozzle array, and at the same time, converts the ejected liquid droplet amount into the color information. Then, on the basis of the color deviation information of the color information relative to the reference color information, the processor 41 performs the recording control and the ink counter control.

This reduces as much as possible the influence of the variation in the ejected liquid droplet amount of each nozzle array onto the recording control and the ink counter control, and hence permits more precise control. That is, regardless of the individual specificity of the recording head or the printer, the density and the hue in the recorded image can be realized as designed, in the recording control. In the ink counter control, the error is reduced further between the calculated consumed ink amount and the actual consumed ink amount.

Further, the information concerning the variation in the ejected liquid droplet amount of each nozzle array and the information concerning the correlation relationship between the ejected liquid droplet amount and the color information are stored in the nonvolatile storage 47 of the recording head 2. Thus, even when the recording head 2 is changed, the recording control and the ink counter control can be performed with higher precision in accordance with the variation in the ejected liquid droplet amount of each nozzle array of the recording head 2 concerned.

It should be noted that the invention is not limited to the above-mentioned embodiments, and that on the basis of the description of the claims, various modifications can be made.

The above-mentioned embodiments have been given for the case that any one of the three indices based on the LAB calorimetric system is used as the color information. However, indices based on another colorimetric system may be used as long as a correlation relationship with the ejected liquid droplet amount of the ink droplet is present.

Further, as for the color correlation information, the above-mentioned embodiments have been given for the case that specific color correlation information is used for each designed liquid droplet amount. However, a correlation formula common to all designed liquid droplet amounts, that is, a formula of the correlation relationship between the ejected liquid droplet amount and the color information in the range covering from the minimum designed liquid droplet amount to the maximum designed liquid droplet amount, may be used as the color correlation information. This avoids the necessity of preparing the color correlation information for each designed liquid droplet amount, and hence reduces and minimizes the usage area of the storage of the recording head.

Further, the above-mentioned embodiments have been given for the case that the deviation (%) itself of the ejected liquid droplet amount relative to the designed liquid droplet amount is used as the deviation information. However, any information indicating the degree of deviation of the ejected liquid droplet amount of each nozzle array relative to the designed liquid droplet amount may be used as the deviation information.

This situation holds also for the color deviation information. That is, any information indicating the degree of deviation of the color information corresponding to the ejected liquid droplet amount relative to the reference color information may be used as the color deviation information.

Further, the above-mentioned embodiments have been given for the case of a printer 1 provided with a single recording head 2. However, the printer may be provided with a plurality of recording heads.

Further, the invention may be applied also to a liquid ejecting apparatus other than the above-mentioned printer, as long as the apparatus comprises a plurality of nozzle arrays adapted to eject liquid droplets. For example, the invention may be applied to a display manufacturing apparatus, an electrode manufacturing apparatus, a chip manufacturing apparatus, and the like.

What is claimed is:

1. A liquid ejecting apparatus, comprising:

a liquid ejecting head, comprising:

pressure chambers, adapted to contain liquid;

nozzle orifices, respectively communicated with the pressure chambers and arranged so as to form nozzle arrays; and pressure generating elements, each of which is operable to generate pressure fluctuation in the liquid contained in one of the pressure chambers to eject at least a first amount of a liquid droplet and a second amount of a liquid droplet, which is different from the first amount, from one of the nozzle orifices toward a target medium;

a first storage, storing first information indicative of a first deviation of the first amount from a first reference amount for each of the nozzle arrays;

a second storage, storing second information indicative of a correlation between the first deviation and a second deviation of the second amount from a second reference amount different from the first reference amount; and a processor, operable to calculate the second deviation for each of the nozzle arrays with reference to the first information and the second information.

2. The liquid ejecting apparatus as set forth in claim 1, further comprising a third storage, storing third information indicative of a correlation between an ejected amount of the liquid droplet and a color reproduced on a target medium, wherein:

the processor is operable to calculate a third deviation of the color from a reference color with reference to the third information and either the first information or the second information; and the processor is operable to adjust, for each of the nozzle arrays, a consumption amount of the liquid consumed for a prescribed operation with reference to the third deviation.

3. The liquid ejecting apparatus as set forth in claim 1, wherein:

a specified amount of a liquid droplet is ejected from one of the nozzle orifices toward a target medium;, the first storage stores third information indicative of a third deviation of the specified amount from a reference amount for each of the nozzle arrays;, the second storage stores fourth information indicative of a correlation between an ejected amount of the liquid droplet and a color reproduced on a target medium, the processor is operable to calculate a fourth deviation of the color from a reference color with reference to the third information and the fourth information; and the processor is operable to adjust, for each of the nozzle arrays, a consumption amount of the liquid consumed for a prescribed operation with reference to the fourth deviation.

4. The liquid ejection apparatus as set forth in claim 2, further comprising a reservoir storing the liquid, wherein the processor is operable to calculate a residual amount of liquid in the reservoir with reference to the adjusted consumption amount.

5. The liquid ejection apparatus as set forth in claim 3, further comprising a reservoir storing the liquid, wherein the processor is operable to calculate a residual amount of liquid in the reservoir with reference to the adjusted consumption amount.

* * * * *